US006199211B1

(12) United States Patent
Franzolino

(10) Patent No.: US 6,199,211 B1
(45) Date of Patent: Mar. 13, 2001

(54) ERGONOMIC HAND, WRIST AND FOREARM SUPPORTER

(76) Inventor: Marc Franzolino, 5250 12th St. North, St. Petersburg, FL (US) 33703

( * ) Notice: Subject to any disclaimer, the term of this patent is extended or adjusted under 35 U.S.C. 154(b) by 0 days.

(21) Appl. No.: 09/620,196

(22) Filed: Jul. 20, 2000

(51) Int. Cl.[7] ..... A41D 19/00

(52) U.S. Cl. ..... 2/161.6; 2/16; 2/162; 128/878; 602/21; 602/64

(58) Field of Search ..... 2/16, 20, 159, 2/160, 161.1, 161.6, 162, 917; 128/878, 879; 602/21, 64; 294/25

(56) References Cited

U.S. PATENT DOCUMENTS

| | | | | |
|---|---|---|---|---|
| D. 335,368 | | 5/1993 | Houston . | |
| 3,421,160 | | 1/1969 | Domenico . | |
| 3,501,773 | | 3/1970 | Stansberry et al. . | |
| 4,183,100 | | 1/1980 | De Marco . | |
| 4,701,963 | | 10/1987 | Overton . | |
| 5,214,799 | | 6/1993 | Fabry . | |
| 5,459,883 | | 10/1995 | Garceau-Verbeck . | |
| 5,566,389 | | 10/1996 | Li . | |
| 5,604,931 | * | 2/1997 | Rhoades | 2/16 |
| 5,649,900 | * | 7/1997 | Kline | 602/21 |
| 5,810,753 | * | 9/1998 | Eberbach | 602/21 |
| 5,815,839 | * | 10/1998 | Safford | 2/161 |
| 5,826,276 | | 10/1998 | Garceau-Verbeck . | |
| 6,013,044 | * | 1/2000 | Estwanik | 602/64 |
| 6,029,277 | * | 2/2000 | Picchione, II | 2/162 |

* cited by examiner

*Primary Examiner*—John J. Calvert
*Assistant Examiner*—Katherine Moran
(74) *Attorney, Agent, or Firm*—Dennis G. LaPointe; Mason & Associates, PA

(57) ABSTRACT

An ergonomic hand, wrist and forearm supporter useful for prevention of injuries caused by repetitive motions while handling implements has a flexible glove body. The palm portion and back portion of the glove body are joined together so as to define a first opening for receiving a forefinger, a second opening for receiving a little finger, and a generally central third opening for simultaneously receiving the middle and index fingers, as well as a fourth opening for receiving a thumb. The palm portion includes a protective padded overlay secured over an area corresponding to a palm's heel area. A plurality of durable protective stays substantially parallel to each other and spaced apart a predetermined distance are transversely secured to the palm portion generally between the palm's heel area and the distal end of the glove body. The stays are capable of flexing for accommodating a hand grabbing an implement. A wrist and forearm protective portion extends from the proximal end of the glove body and is of sufficient length to extend a predetermined distance from the wrist along the forearm. The wrist and forearm protective portion has an overflap and an elastomeric band for securing to the wrist and forearm, and a protective overlay guard to protect the inside of the wrist.

17 Claims, 6 Drawing Sheets

ERGONOMIC HAND, WRIST AND FOREARM SUPPORTER

BACKGROUND OF THE INVENTION

1. Field of the Invention

The invention relates to a supporter for the hand, wrist and forearm of a person for use in preventing injuries due to repetitive industrial motions while handling equipment and products of manufacture, agriculture and the like.

2. Description of Related Art

Supporters for hands and wrist are known in the art. However, most are designed for limited non-industrial purposes such as for sports. For example, batting gloves for baseball, bowling gloves, and golfing gloves. Many are designed with the primary purposes of enabling a better grip on the bat, ball, or club, thereby minimizing slippage when manipulating an object or implement such as a bat, handle or trigger assembly. Gloves used in industrial settings are primarily designed to avoid blisters, protect the hands from getting wet or getting contaminated such as when handling hazardous waste.

Known related art includes a glove with partial fingers and a padded palm area as depicted in U.S. Pat. No. 4,701,963 to Overton, a carpal tunnel prevention padded glove as depicted in U.S. Pat. No. 5,214,799 to Fabry, a sports glove as depicted in U.S. Pat. No. 3,501,773 to Stansberry et al., a bowling padded glove as depicted in U.S. Pat. No. 3,421,160 to Domenico, a specialty partial finger glove as depicted in U.S. Pat. No. 4,183,100 to De Marco, a general support glove as depicted in U.S. Design Pat. No. D335,368 to Houston, a grip enhancer as depicted in U.S. Pat. Nos. 5,459,883 and 5,826,276 to Garceau-Verbeck, and a wrist and partial palm shock absorbing glove as depicted in U.S. Pat. No. 5,566,389 to Li.

None of the devices in the above references solve the problems related to strain on the wrist and palms due to repetitive motions in an industrial setting, for example, when twisting, pulling and rolling high pressure hoses and when using triggered water and air nozzles. An object of the present invention would provide a glove which will, when operating industrial devices, prevent the weakening of the wrists and prevent tendon strains and soreness, including the development of tendonitis, in the inner palm and lower forearm. In addition, the current gloves on the market simply do not adequately protect or address the specific needs or physical issues caused by industrial repetitive motions. Even combining some of the features of the above-identified patents does not solve the problem adequately as the resultant glove would still not offer the freedom of movement, lightness, support and protection that the present invention provides.

Examples of industrial applications for the use of the present invention are line hand packing, construction, assembly line manufacturing, cable layers, commercial fishing, landscaping, gardening and agricultural work, that is, almost any industrial application involving wrist and hand movements, especially long term repetitive motions.

SUMMARY OF THE INVENTION

The present invention is a one piece fingerless glove with a wrist extension and support brace area, designed with ergonomic principles in mind. The middle finger and index finger are centered through a central opening to prevent misalignment of tendons due to wandering of individual fingers connected to the main tendons of the hand. The palm is ribbed with nylon or thermoplastic stays to protect the inner palm from excessive pressure contact points. The heel of the palm also has a preferred leather pad overlay sewn externally similar to a preferred leather guard sewn externally to the inner wrist and lower forearm area. This protects the inner fleshy part at the heel of the palm as well as protects the inner wrist and lower forearm area from scraping or impact injuries. Tension and securing of the glove is done by an overflap and an elastic band that wraps around, both securing with hook and loop fasteners such as Velcro™. Also included is an open area on the backside top of the glove body for venting or air breathing.

More specifically, the present invention is an ergonomic hand, wrist and forearm supporter useful for prevention of injuries caused by repetitive motions while handling implements, such as high pressure hoses, nozzles, tools and the like, comprising a flexible glove body which has a palm portion and a back portion that defines an open space for receiving a hand. The glove body has a distal end and a proximal end.

The palm portion and back portion are joined together at the distal end of the glove body so as to define a first opening for receiving a forefinger, a second opening for receiving a little finger, and a generally central third opening for simultaneously receiving a middle finger and an index finger. The palm portion and back portion further define a fourth opening for receiving a thumb.

The palm portion includes a protective padded overlay secured over an area corresponding to a palm's heel area. The protective padded overlay is typically made from a durable and flexible material, for example, leather, synthetics thereof and combinations thereof.

A plurality of durable protective stays, such as a ribbed strip of thermoplastic or nylon material, each of a predetermined width and length, and substantially parallel to each other and spaced apart a predetermined distance, are transversely secured to the palm portion generally between the palm's heel area and the distal end of the glove body. The stays are capable of flexing for accommodating a hand grabbing an implement such as a handle, hose, tool, nozzle and the like.

A wrist and forearm protective portion extends from the proximal end of the glove body and is of sufficient length to extend a predetermined distance from the wrist along the forearm. The wrist and forearm protective portion has loosening means for allowing a hand to be slipped into the glove body as well as means for adjusting the wrist and forearm protective portion to accommodate a size and shape of the wrist and forearm and to secure and apply tension around the wrist and forearm.

The distal end of the glove body defines a snug fit between the first opening and the third opening to separate the forefinger and the middle and index fingers, and between the second opening and the third opening to separate the middle and index fingers and the little finger. The snug fit is at a base of the fingers. The glove is fingerless, therefore the supporter ends at the distal end of the glove body.

In a preferred embodiment, the protective padded overlay is made of two separate sections, each secured so as to overlay each of the two defined heel portions of the hand. This feature provides protection to the fleshy lower palm portion or heel of the palm.

The plurality of durable protective stays may be arranged in width and length so as to accommodate any multiple of stays. Although a preferred practical application is 3 or 4 stays, as few as 1 or 2 may be used and as many as 5–10 relatively thin stays may be used. The plurality of durable protective stays are typically made from polymeric materials, plastic materials, nylon materials, or combinations thereof.

The back portion of the glove body further includes vent means, which can be perforations, but is typically an opening or cut away section, which may be shaped as an oval, a circle, or any other more ornamental shape.

The ergonomic supporter glove body can be made from a variety of materials; however, a preferred application of the invention would use nylon material, rayon material, polyester material, synthetics thereof, or combinations thereof. These materials are lightweight, non-restrictive, and washable for addressing hygienic and environmental concerns.

The loosening means for allowing the hand to be slipped into the glove body and the means for adjusting the wrist and forearm protective portion to accommodate the size of the wrist and forearm and to secure and apply tension around said wrist and forearm, includes an overflap portion, wherein the wrist and forearm protective portion may be opened and separated for inserting a hand in the glove body and for initial tightening of the wrist and forearm protective portion on a backside of the wrist and forearm. The overflap portion has a longitudinal inseam with a hook and loop fastener portion for detachably mating with a corresponding hook and loop fastener so as to wrap and tightly secure the wrist and forearm protective portion around the wrist and forearm. The wrist and forearm protective portion essentially acts as a brace.

The wrist and forearm protective portion preferably has a protective overlay guard secured to the wrist and forearm protective portion, the protective overlay guard being a predetermined width and length and located so as to extend the substantial length of the wrist and forearm protective portion and protect an inside portion of the wrist and forearm from impact and scraping. This protective overlay guard is preferably made from one of leather, synthetics thereof, and combinations thereof.

An elastomeric band or elastic woven stretch fabric is provided for applying an adjustable tension around the wrist and for reinforcing the protective overlay guard on the inside portion of the wrist. The elastomeric band may be fixed to a first side of the protective overlay guard and an opposite end of the elastomeric band is capable of being detachably secured in tension on a second side of the protective overlay guard.

The elastomeric band is adjustably detachably secured with hook and loop fasteners at its opposite end.

All stays, padding overlays for the heel of the palm, and overlay guard can be sewn in place in a preferred application of the invention; however, there may be other means known in the art such as by using adhesives to affix such components.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
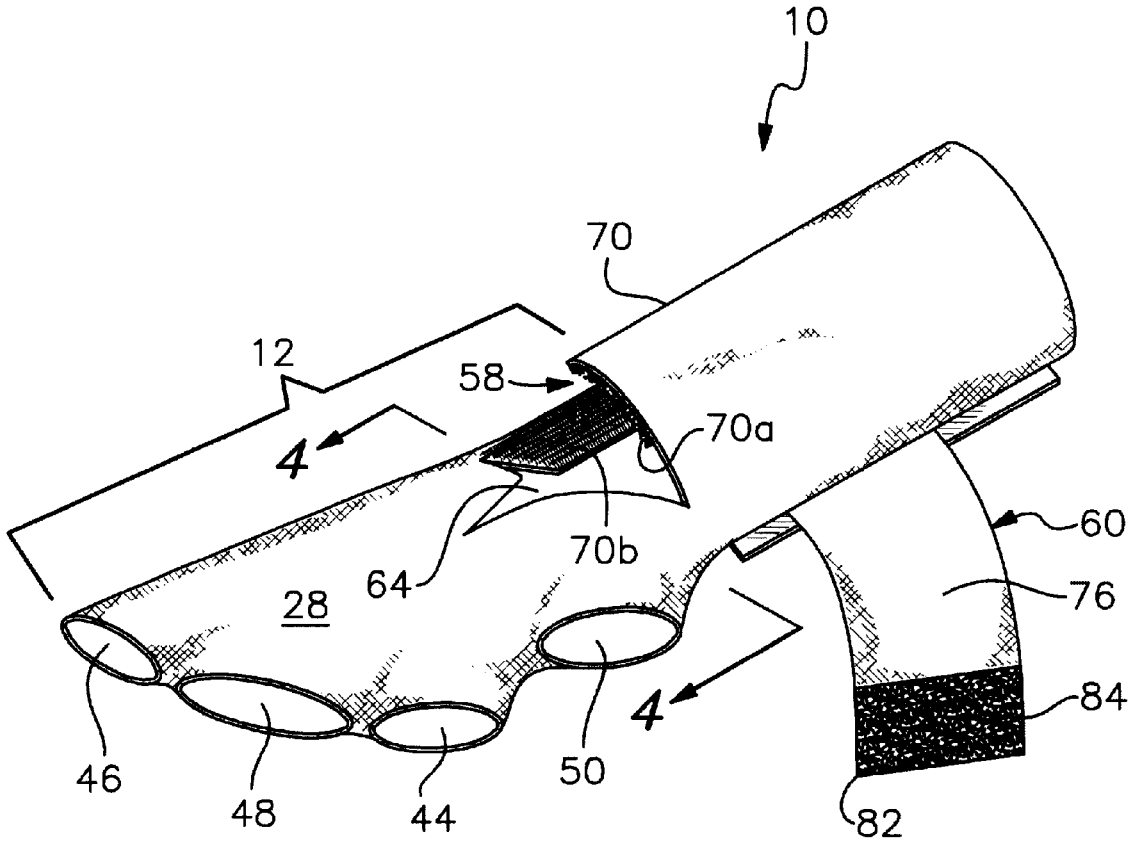
FIG. 1 is a perspective plan view of the invention.
Figure 2:
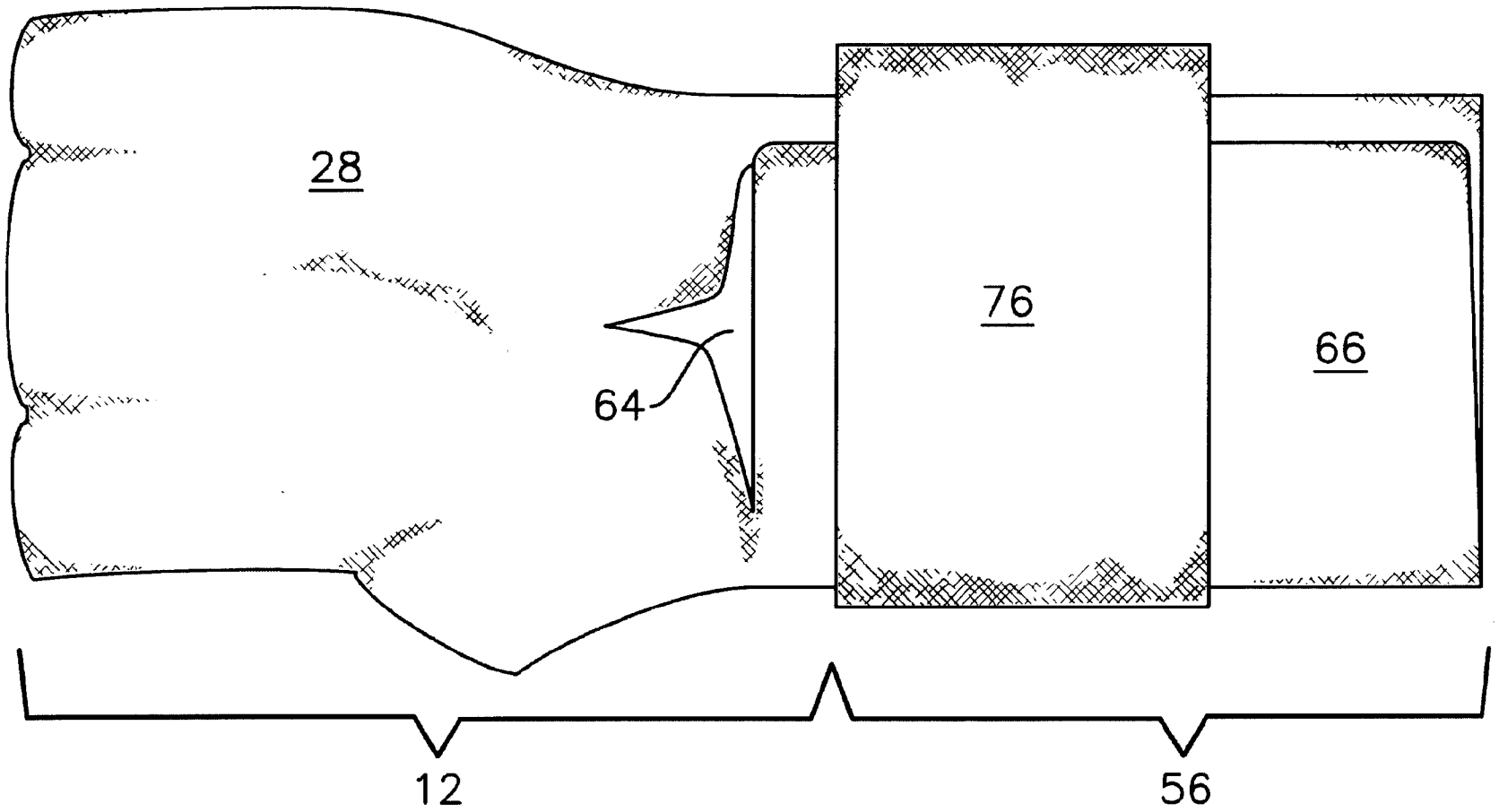
FIG. 2 is a plan view of the invention.
Figure 3:
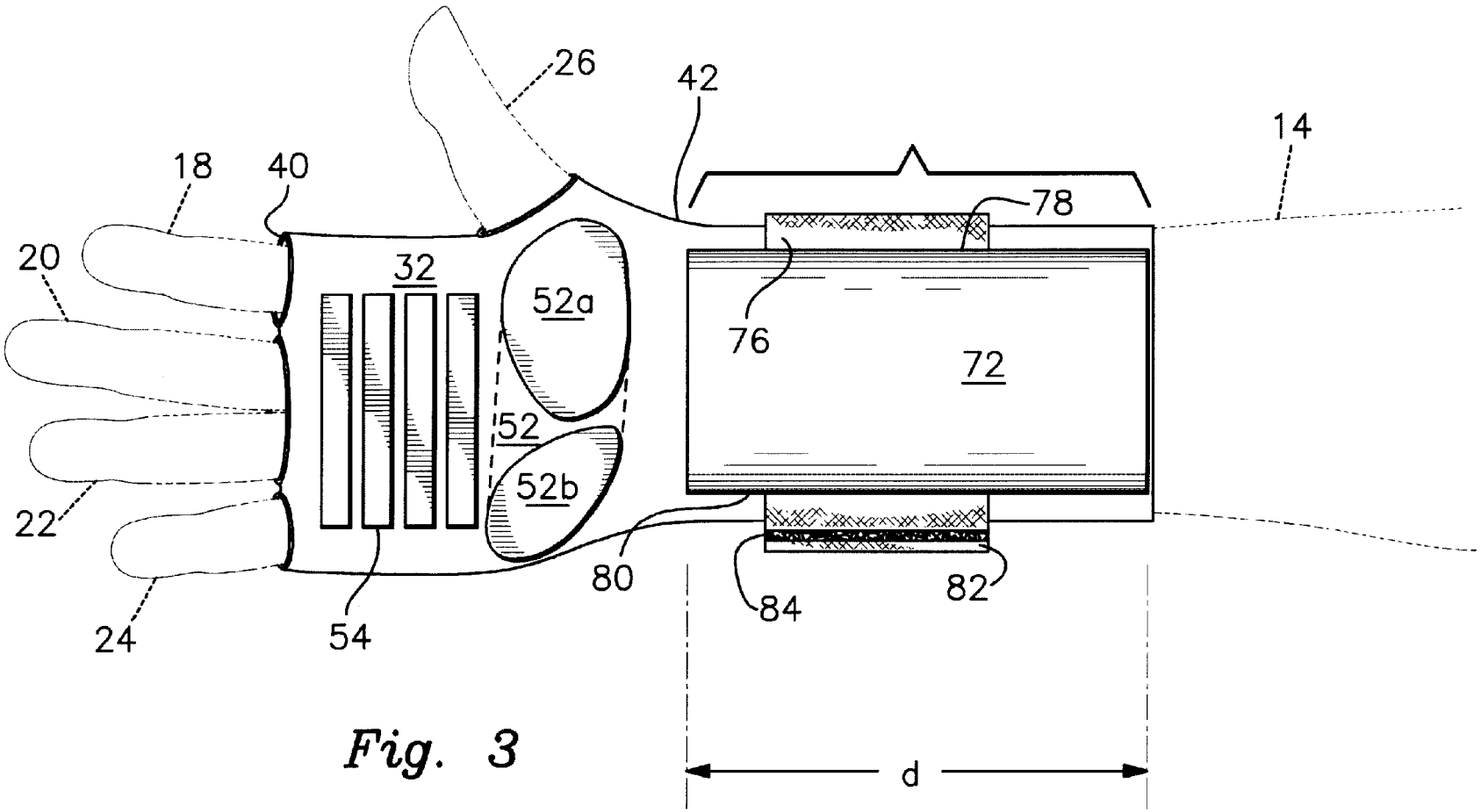
FIG. 3 is a palm side view of the invention with a hand shown in phantom for illustration purposes.
Figure 4:
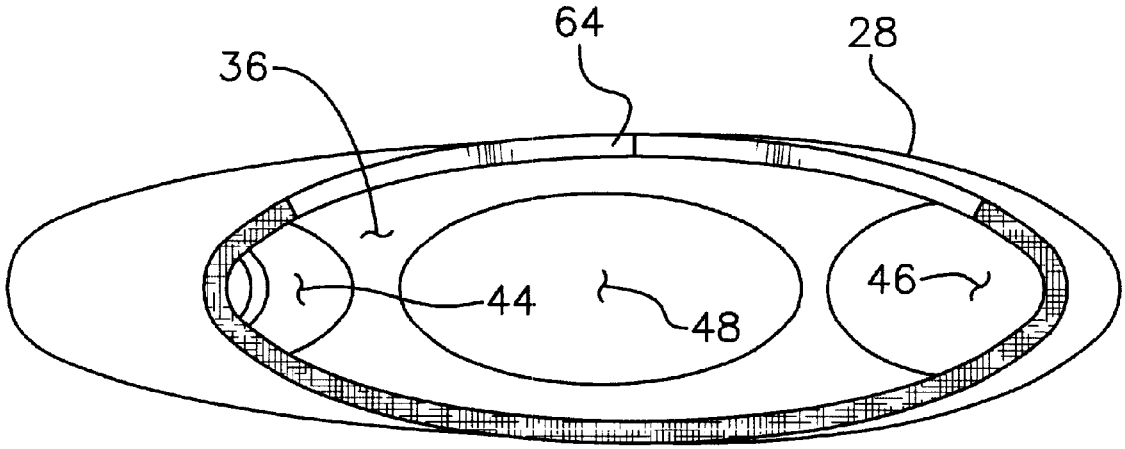
FIG. 4 is a cross-sectional view of the invention taken from view 4—4 of FIG. 1.
Figure 5:
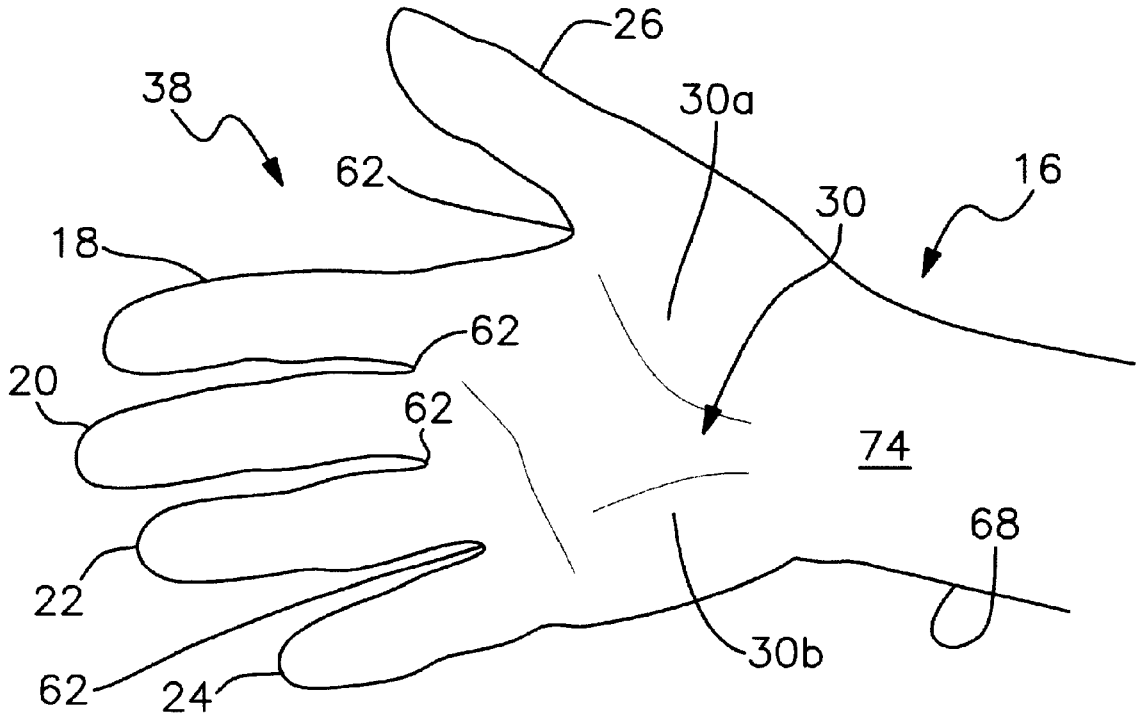
FIG. 5 is a view of a hand for reference use in reading the specifications herein.
Figure 6:
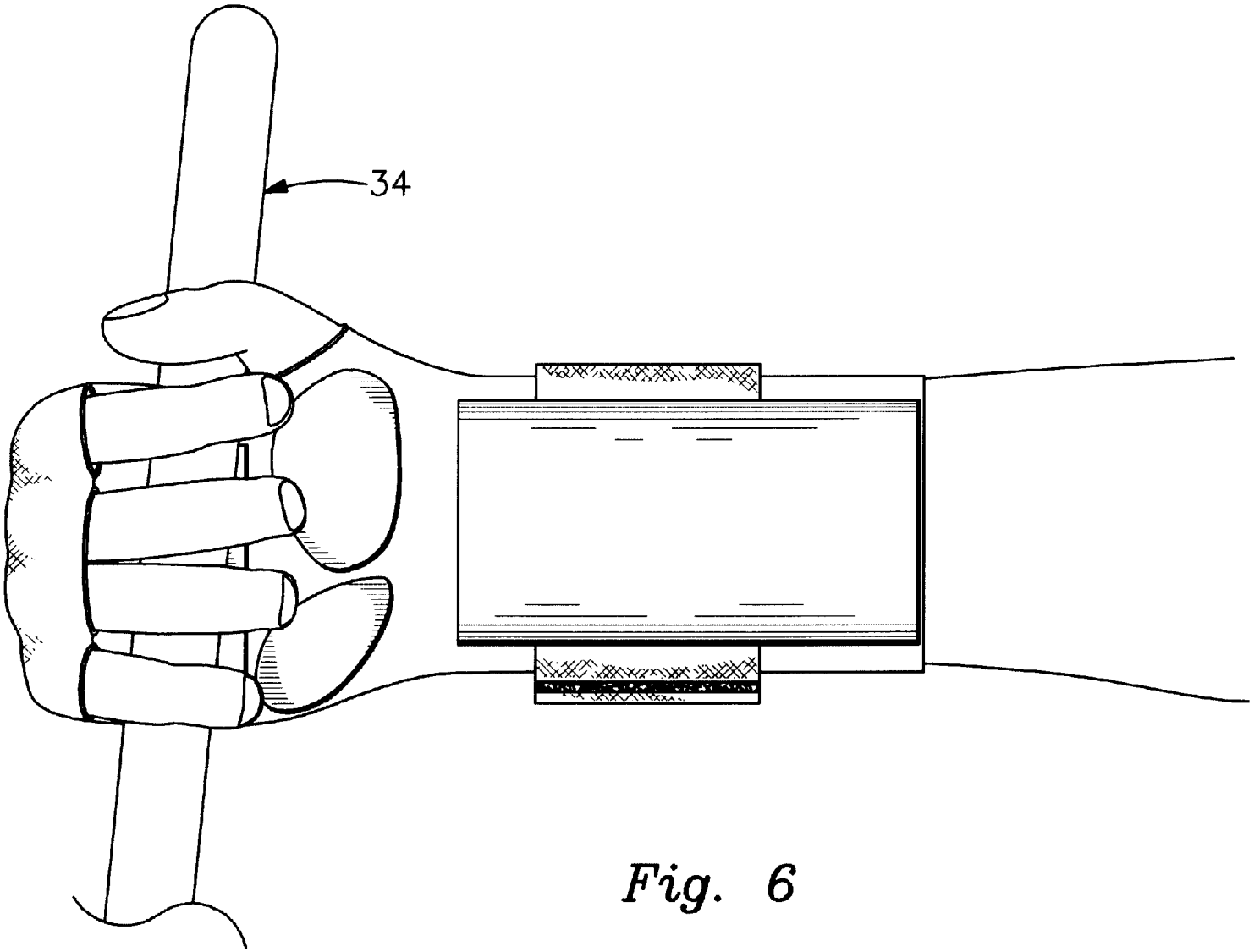
FIG. 6 is a view of the invention being worn on a hand grasping an implement.

Referring now to the drawings, in particular FIGS. 1–6, the invention which is an ergonomic hand, wrist and forearm supporter useful for prevention of injuries caused by repetitive motions while handling implements 34, depicted generally as 10, comprises a flexible glove body 12 which has a palm portion 32 and a back portion 28 defining an open space 36 for receiving a hand 38. The glove body 12 has a distal end 40 and a proximal end 42.

The palm portion 32 and back portion 28 are joined together at the distal end 40 of the glove body 12 so as to define a first opening 44 for receiving a forefinger 18, a second opening 46 for receiving a little finger 24, and a generally central third opening 48 for simultaneously receiving a middle finger 20 and an index finger 22. The palm portion 32 and back portion 28 further define a fourth opening 50 for receiving a thumb 26. The ergonomic glove 10 can be sized to fit men and woman sizes using typical, small, medium, large and extra large references, wherein the first, second, third and fourth openings 44,46,48,50 will be sized accordingly to accommodate a relatively snug fit, yet a comfortable fit for both the hand body (palm and back portions 32, 28) and fingers 18,20,22,24,26 exiting the respective openings.

The palm portion 32 further includes a protective padded overlay 52 secured over an area corresponding to a palm's heel area 30. The protective padded overlay 52 is made from a durable and flexible material; for example, leather, synthetics thereof, and combinations thereof. Although the protected padded overlay 52 may be formed as a continuous overlay to generally conform and cover the two fleshy lower palm areas at the palm's heel, it is preferable that the overlay be divided into two distinct sections as further described below. A plurality of durable protective stays 54, each of a predetermined width and length, and substantially parallel to each other and spaced apart a predetermined distance, the stays being overlays transversely secured to the palm portion 32 generally between the palm's heel area 30 and the distal end 40 of the glove body 12. The stays 54 are capable of flexing for accommodating a hand 38 grabbing an implement 34. A wrist and forearm protective portion 56 extends from the proximal end 42 of the glove body 12 and is of sufficient length to extend a predetermined distance "d" from the wrist 16 along the forearm 14. The wrist and forearm protective portion 56 has loosening means 58 for allowing a hand 38 to be slipped into the glove body 12 and means 60 for adjusting the wrist and forearm protective portion 56 to accommodate a size and shape of the wrist 16 and forearm 14 and to secure and apply tension around said wrist 16 and forearm 14.

The distal end 40 of the glove body 12 defines a snug fit between the first opening 44 and the third opening 48 to separate the forefinger 18 and the middle and index fingers 20,22, and between the second opening 46 and the third opening 48 to separate the middle and index fingers 20,22 and the little finger 24. The snug fit is at the base 62 of the fingers 18,20,22,24. The ergonomic supporter 10 is fingerless; therefore, the snug fit ends at the distal end 40 of the glove body 12 and continues in a generally longitudinal direction to provide a snug fit between the first opening 44 and the fourth opening 50 which separate the forefinger 18 and the thumb 26.

As previously mentioned, the protective padded overlay 52 may be two separate sections 52*a*,52*b*, each secured so as to overlay each of two defined heel portions 30*a*,30*b* of the hand 38. The protective padded overlay is made from one of leather, synthetics thereof, and combinations thereof.

The plurality of durable protective stays 54 may be arranged in width and length so as to accommodate any number of stays 54. Although a preferred practical application may be to apply 3 or 4 stays 54, as few as 1 or 2 stays 54 may be used and as many as 5–10 relatively thin stays 54 may be incorporated.

The back portion 28 of the glove body 12 preferably has vent means 64, which can typically be incorporated in a number of ways known in the art from a simple opening or cut away section, which may be shaped in a preferred configuration such as oval, round, or a more decorative or artistic cut, to the incorporation of a perforated or mesh cloth on the back portion 28 of the glove body 12.

The loosening means 58 for allowing the hand 38 to be slipped into the glove body 12 and the means 60 for adjusting the wrist and forearm protective portion 56 to accommodate the size of the wrist 16 and forearm 14 and to secure and apply tension around said wrist 16 and forearm 14 includes an overflap portion 66, wherein the wrist and forearm protective portion 56 may be opened and separated for inserting a hand 38 in the glove body 12 and for initial tightening of the wrist and forearm protective portion 56 on a backside 68 of the wrist 16 and forearm 14 and an elastomeric band 76 further described below for securing and providing tension around the wrist 16. The overflap portion 66 has a longitudinal inseam 70 with a hook and loop fastener portion 70*a* for detachably mating with a corresponding hook and loop fastener 70*b* so as to wrap and tightly secure the wrist and forearm protective portion 56 around said wrist 16 and forearm 14.

The wrist and forearm protective portion 56 preferably has a protective overlay guard 72 secured to the wrist and forearm protective portion 56. The protective overlay guard 72 is typically a predetermined width and length and located so as to extend the substantial length of the wrist and forearm protective portion 56 and to protect an inside portion 74 of the wrist 16 and forearm 14 from impact and scraping.

Although the protective overlay guard 72 is preferably made from one of leather, synthetics thereof, and combinations thereof, it may be made from thermoplastic materials or other polymeric materials.

An elastomeric band 76 or elastic woven stretch fabric is provided for adjustable tensioning around the wrist 16 and for reinforcing the protective overlay guard 72 on the inside portion 74 of the wrist 16. Although the elastomeric band 76 may be secured in a number of ways known in the art, including securing under the protective overlay guard 72, it is typically fixed to a first side of the protective overlay guard 72 generally by stitching it along a side edge of the protective overlay guard 72, and an opposite end 82 of the elastomeric band 76 is capable of being detachably secured in tension on a second side 80 of the protective overlay guard 72. The opposite end 82 is typically adjustably detachably secured with hook and loop fasteners.

As seen from the foregoing description, the present invention satisfies a long felt need to provide an ergonomic glove for industrial applications where long term repetitive motions using tools, nozzles, and other implements can cause injury, thereby lowering production overhead costs due to lost services of employees, and lowering insurance costs.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. An ergonomic hand, wrist and forearm supporter useful for prevention of injuries caused by repetitive motions while handling implements, comprising:

a flexible glove body having a palm portion and a back portion defining an open space for receiving a hand, a distal end and a proximal end;

the palm portion and back portion being joined together at the distal end of the glove body so as to define a first opening for receiving a forefinger, a second opening for receiving a little finger, and a generally central third opening for simultaneously receiving a middle finger and an index finger;

the palm portion and back portion further defining a fourth opening for receiving a thumb;

the palm portion further including a protective padded overlay secured over an area corresponding to a palm's heel area, the protective padded overlay being made from a durable and flexible material;

a plurality of durable protective stays, each of a predetermined width and length, and substantially parallel to each other and spaced apart a predetermined distance, the stays being overlays transversely secured to the palm portion generally between the palm's heel area and the distal end of the glove body, the stays being capable of flexing for accommodating a hand grabbing an implement; and a wrist and forearm protective portion extending from the proximal end of the glove body and of sufficient length to extend a predetermined distance from the wrist along the forearm, the wrist and forearm protective portion having loosening means for allowing a hand to be slipped into the glove body and means for adjusting the wrist and forearm protective portion to accommodate a size and shape of the wrist and forearm and to secure and apply tension around said wrist and forearm.

2. The ergonomic supporter according to claim 1, wherein the distal end of the glove body defines a snug fit between the first opening and the third opening to separate the forefinger and the middle and index fingers, and between the second opening and the third opening to separate the middle and index fingers and the little finger, the snug fit being at a base of the fingers, and wherein the palm portion and the back portion of the glove body further define a generally longitudinal snug fit between the first opening and the fourth opening which separate the forefinger and the thumb.

3. The ergonomic supporter according to claim 1, wherein the protective padded overlay is made of two separate sections, each secured so as to overlay each of two defined heel portions of the hand.

4. The ergonomic supporter according to claim 3, wherein the protective padded overlay is made from one of leather, synthetics thereof, and combinations thereof.

5. The ergonomic supporter according to claim 1, wherein the protective padded overlay is made from one of leather, synthetics thereof, and combinations thereof.

6. The ergonomic supporter according to claim 1, wherein the plurality of durable protective stays is 2.

7. The ergonomic supporter according to claim 1, wherein the plurality of durable protective stays is 3.

8. The ergonomic supporter according to claim 1, wherein the plurality of durable protective stays is 4.

9. The ergonomic supporter according to claim 1, wherein the plurality of durable protective stays are made from one of polymeric material, plastic material, nylon material, and combinations thereof.

10. The ergonomic supporter according to claim 1, wherein the back portion of the glove body further includes vent means.

11. The ergonomic supporter according to claim 10, wherein the vent means is an opening on the back portion of the glove body.

12. The ergonomic supporter according to claim 1, wherein the glove body is made from one of nylon material, rayon material, polyester material, synthetics thereof, and combinations thereof.

13. The ergonomic supporter according to claim 1, wherein the loosening means for allowing the hand to be slipped into the glove body comprises:

an overflap portion, wherein the wrist and forearm protective portion may be opened and separated for inserting a hand in the glove body and for initial tightening of the wrist and forearm protective portion on a backside of the wrist and forearm, the overflap portion having a longitudinal inseam with a hook and loop fastener portion for detachably mating with a corresponding hook and loop fastener so as to wrap and tightly secure the wrist and forearm protective portion around said wrist and forearm.

14. The ergonomic supporter according to claim 13, wherein the wrist and forearm protective portion further comprises:

a protective overlay guard secured to the wrist and forearm protective portion, the protective overlay guard being a predetermined width and length and located so as to extend the substantial length of the wrist and forearm protective portion and protect an inside portion of the wrist and forearm from impact and scraping.

15. The ergonomic supporter according to claim 14, wherein the protective overlay guard is made from one of leather, synthetics thereof, and combinations thereof.

16. The ergonomic supporter according to claim 14, wherein the means for adjusting the wrist and forearm protective portion to accommodate the size of the wrist and forearm and to secure and apply tension around said wrist and forearm comprises:

an elastomeric band for providing adjustable tensioning around the wrist and for reinforcing the protective overlay guard on the inside portion of the wrist, the elastomeric band being fixed to a first side of the protective overlay guard and an opposite end of the elastomeric band being capable of being detachably secured in tension on a second side of the protective overlay guard.

17. The ergonomic supporter according to claim 16, wherein the elastomeric band is adjustably detachably secured with hook and loop fasteners.

* * * * *

UNITED STATES PATENT AND TRADEMARK OFFICE

CERTIFICATE OF CORRECTION

PATENT NO. : 6,199,211 B1
DATED : March 13, 2001
INVENTOR(S) : Marc Franzolino

It is certified that error appears in the above-identified patent and that said Letters Patent is hereby corrected as shown below:

Column 5,
Line 57, replace "first side of" with -- first side 78 of --.
Line 63, replace "loop fasteners." with -- loop fasteners 84. --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*